United States Patent [19]

Stachel et al.

[11] 3,962,765

[45] June 15, 1976

[54] METHOD OF INSTALLING A MOUNT ASSEMBLY IN A MULTI-BEAM CATHODE RAY TUBE

[75] Inventors: Charles Peter Stachel, Clarks Summit; Morris Robert Weingarten, Lancaster, both of Pa.

[73] Assignee: RCA Corporation, New York, N.Y.

[22] Filed: June 27, 1975

[21] Appl. No.: 590,921

[52] U.S. Cl. ..... 29/25.13; 316/23

[51] Int. Cl.[2] ..... H01J 9/18

[58] Field of Search ..... 29/25.1, 25.11, 25.13, 29/25.15, 25.16; 316/23, 29

[56] References Cited

UNITED STATES PATENTS 3,807,006 4/1974 Segro et al. ..... 29/25.13

*Primary Examiner*—Roy Lake
*Assistant Examiner*—James W. Davie
*Attorney, Agent, or Firm*—Glenn H. Bruestle; William H. Murray

[57] ABSTRACT

A bulb assembly, including a faceplate panel portion and a mount assembly, comprising a stem and a multi-beam electron gun assembly, are positioned in axial alignment on respective central longitudinal axes. A reference plane which contains the central longitudinal axis of the bulb assembly and is parallel to a plurality of parallel phosphor lines disposed on one surface of the faceplate panel portion, is established. An orientation plane is then defined with reference to the structure of the electron gun assembly. The orientation plane contains the central longitudinal axis of the mount assembly and two reference points on the structure of the electron gun assembly and passes through the in-line electron beam apertures. The mount assembly is then rotated with respect to the bulb assembly on the coincident longitudinal axes until the orientation plane is perpendicular to the reference plane as optically indicated by the alignment of the two reference points on an optical display which has superimposed the image of the phosphor lines. Then, while maintaining this rotational orientation, the mount assembly is actually moved within the bulb assembly to a desired longitudinal location with respect to the faceplate panel portion. The bulb assembly and mount assembly are then permanently assembled.

18 Claims, 10 Drawing Figures

METHOD OF INSTALLING A MOUNT ASSEMBLY IN A MULTI-BEAM CATHODE RAY TUBE

BACKGROUND OF THE INVENTION

This invention relates to a method of assembling a cathode ray tube bulb assembly and mount assembly, and particularly to a method of assembling an in-line multi-beam electron gun assembly in a color television picture tube bulb of the phosphor line screen type.

In a commercial color television picture tube of the apertured mask type having a three-color viewing screen structure, the viewing screen structure is photographically printed using light centers simulative of the position of the deflection center of each of the three electron beams in the final tube. A mount assembly comprising a three-beam electron gun is subsequently installed in the tube. During the assembly of the electron gun structure in the final tube, the axis of each cathode must be oriented to coincide with the light centers used to print the viewing screen structure within a desired rotational tolerance about the central longitudinal axis of the tube. In commercial color television picture tubes using dynamic divergence circuitry, a mount assembly including an electron gun assembly having three cathodes in fixed orientation ordinarily must be positioned in the tube within three degrees of rotation. In a commercial color television picture tube using no dynamic convergence circuitry or simplified dynamic convergence circuitry, a more accurate rotational positioned in the mount assembly is usually required.

In one prior method for assembling a multi-beam electron gun structure, the alignment is accomplished by two separate assembly operations. During the mount assembly operation, the central longitudinal axis of the electron gun assembly is aligned with the stem axis and the cathode axes are rotationally aligned with the stem leads. Then, the electron gun assembly is attached to the stem leads with metal wires and ribbons to form a mount assembly. In the subsequent mount sealing operation, the preassembled mount assembly is positioned and oriented with respect to the bulb assembly and then sealed to the bulb assembly on a sealing unit. The sealing unit holds and orients the bulb assembly rotationally with respect to the major and minor axes and axially with respect to the longitudinal axis of the bulb assembly. The sealing machine also holds and orients the mount assembly axially with respect to the stem and rotationally with respect to the stem leads.

In the mount sealing operation, the mount assembly is held rotationally with the stem leads positioned within aligned holes on the sealing machine. Since the holes include a clearance for loading and the mount assembly includes assembly tolerances, the rotational alignment of mount assembly with respect to the screen structure cannot accurately be maintained. In addition, since the mount assembly is preassembled and transported to the sealing machine, the fragile wires supporting the electron gun assembly may be accidentally bent, thereby misaligning the electron gun assembly with the stem leads. This may result in an angular misalignment of the electron gun assembly when the stem leads are used to angularly align the bulb assembly and the mount assembly.

In addition, the heat used to effect mount sealing may cause a relaxation of the rotational stresses placed on the wires supporting the electron gun assembly when the electron gun assembly was initially aligned with the stem leads. This relaxation could cause further rotational misalignment. Furthermore, gauging the amount of angular rotation of the preassembled mount assembly after assembly and gauging the amount of angular rotation of the mount assembly in the assembled tube may be required to assure accurate rotational positioning of the electron beam axes with respect to the viewing screen structure in the finished tube.

In another prior method for assembling a multi-beam electron gun structure, as described in U.S. Pat. No. 3,807,006 issued to Segro et al., the alignment is accomplished by mechanically sensing the position of the electron gun assembly with respect to alignment pads on the bulb assembly. While this method is an improvement in that it obviates the necessity to align the electron gun assembly with the stem axis which is in turn aligned with respect to the bulb assembly reference pads, this method entails the necessity of physically contacting the electron gun assembly thereby introducing its own errors into the total alignment error.

Still another method for assembling a multi-beam electron gun structure comprises optically sensing the position of the electron gun assembly with respect to alignment pads on the bulb assembly. This method is an improvement over the other methods in that no physical contact is required to align the electron gun assembly with respect to these alignment pads on the bulb assembly. However, it must be noted that in all previous methods, the alignment is conducted with respect to reference pads located on the bulb assembly. It must also be noted that the optimum alignment requires aligning the electron gun assembly with the photographically printed screen on the interior surface of the faceplate panel. The introduction of an intermediate reference such as the reference pads on the bulb assembly can, and very probably does, interject additional alignment errors into the overall alignment scheme. Consequently, the most desirable method of alignment is one which aligns the electron beam apertures directly to the luminescent deposits on the screen.

SUMMARY OF THE INVENTION

A method of assembling a cathode ray tube having a bulb assembly and a mount assembly. The bulb assembly has a central longitudinal axis and includes a faceplate panel having a plurality of phosphor deposits disposed on one surface thereof in a predetermined pattern. The mount assembly has a central longitudinal axis and includes a multi-beam electron gun assembly. The method comprises the steps of first positioning the central longitudinal axis of the bulb assembly in a predetermined orientation. Next, optically sensing the rotational position of the phosphor pattern about the central longitudinal axis of the bulb assembly. Then positioning the bulb assembly about the central longitudinal axis thereof so that the phosphor pattern is at a predetermined rotational position. Next the mount assembly is positioned in a location spaced from the bulb assembly with the central longitudinal axis thereof coincident with the central longitudinal axis of the bulb assembly. Next, optically sensing the rotational position of the electron gun assembly about the coincident longitudinal axes. Then the mount assembly is rotated about the coincident axes until the electron gun assembly is at a prescribed rotational orientation with respect to the phosphor pattern. Then, while maintaining this rotational orientation, the mount assembly is moved along the longitudinal axis to a desired longitudinal location with respect to the faceplate panel at which time the mount assembly is then permanently fixed to the bulb assembly.

DETAILED DESCRIPTION

Figure 1:
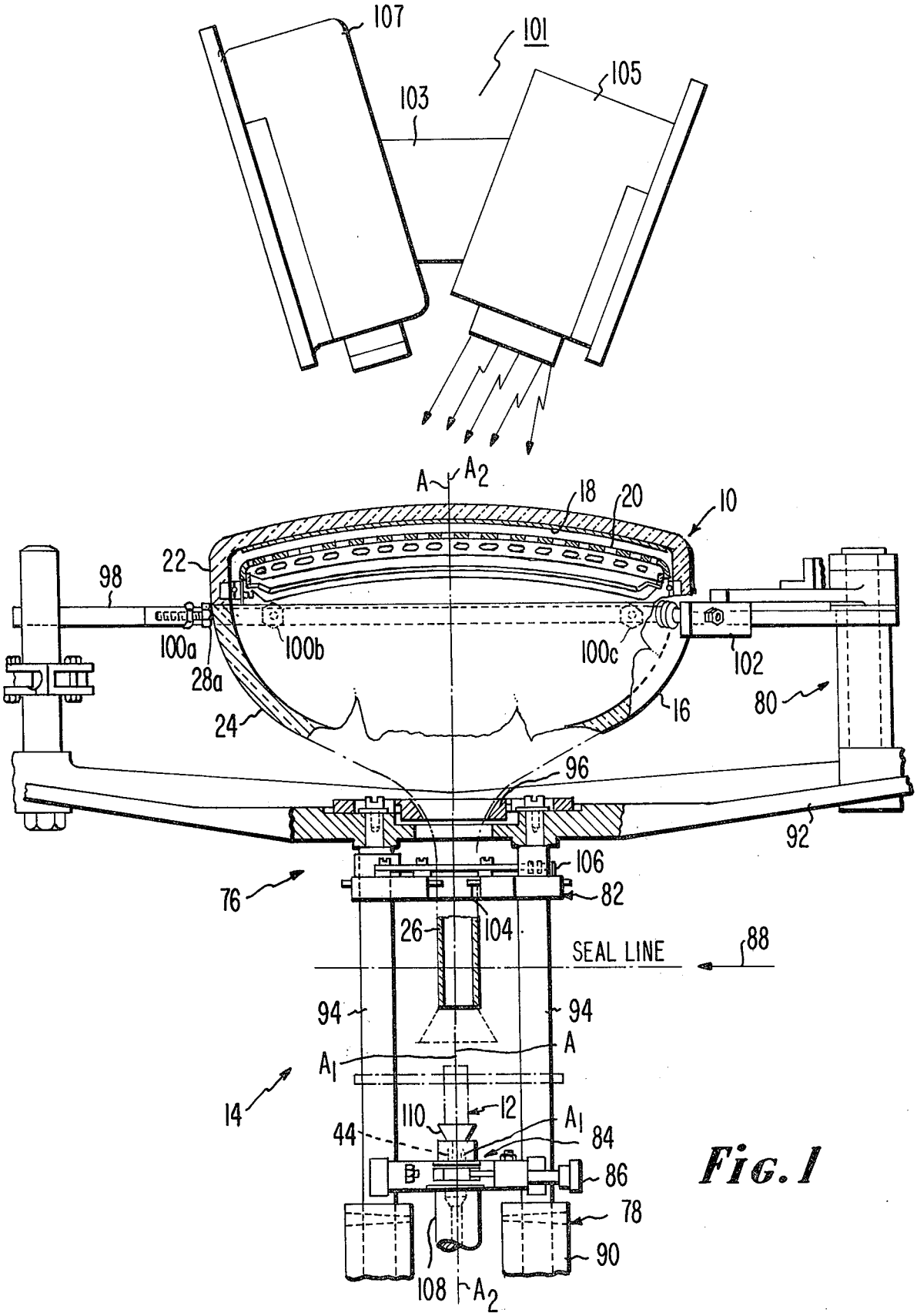
FIG. 1 is a broken-away sectional view of a bulb assembly for a cathode ray tube positioned on a head assembly of a mount sealing machine.

FIG. 1 illustrates a sectional view of a bulb assembly 10 and an outline of a mount assembly 12 for a color television picture tube of the apertured-mask type positioned on an apparatus known in the art as a mount sealing machine 14 (only partially shown). The mount sealing machine 14 is used to install the mount assembly 12 in a precise location and orientation within the bulb assembly 10 to make a color television picture tube assembly. The bulb assembly 10 includes a central longitudinal axis A—A and the mount assembly 12 includes a central longitudinal axis $A_1$—$A_1$.

A color television picture tube bulb assembly 10 comprises a glass envelope 16, a three-color phosphor viewing screen structure 18 and an apertured-mask electrode 20. The glass envelope 16 includes a rectangular faceplate portion 22 having a major axis X—X and a minor axis Y—Y (see FIG. 2), a funnel portion 24 and a neck portion 26. The three-color phosphor viewing screen structure 18 is supported on the inner surface of the faceplate portion 22. The viewing screen structure 18 is preferably a line-screen structure with phosphor lines 19 (see FIG. 2) extending parallel to the minor axis Y—Y of the faceplate 22.

The aperture-mask electrode 20 is positioned in the envelope 16 in a predetermined spaced relationship with the viewing screen structure 18. The aperture-mask electrode 20 used with the line-screen structure 18 includes slot-shaped apertures (not shown). The slot-shaped apertures are positioned parallel to the phosphor lines 19 of the viewing screen structure 18.

Figure 2:
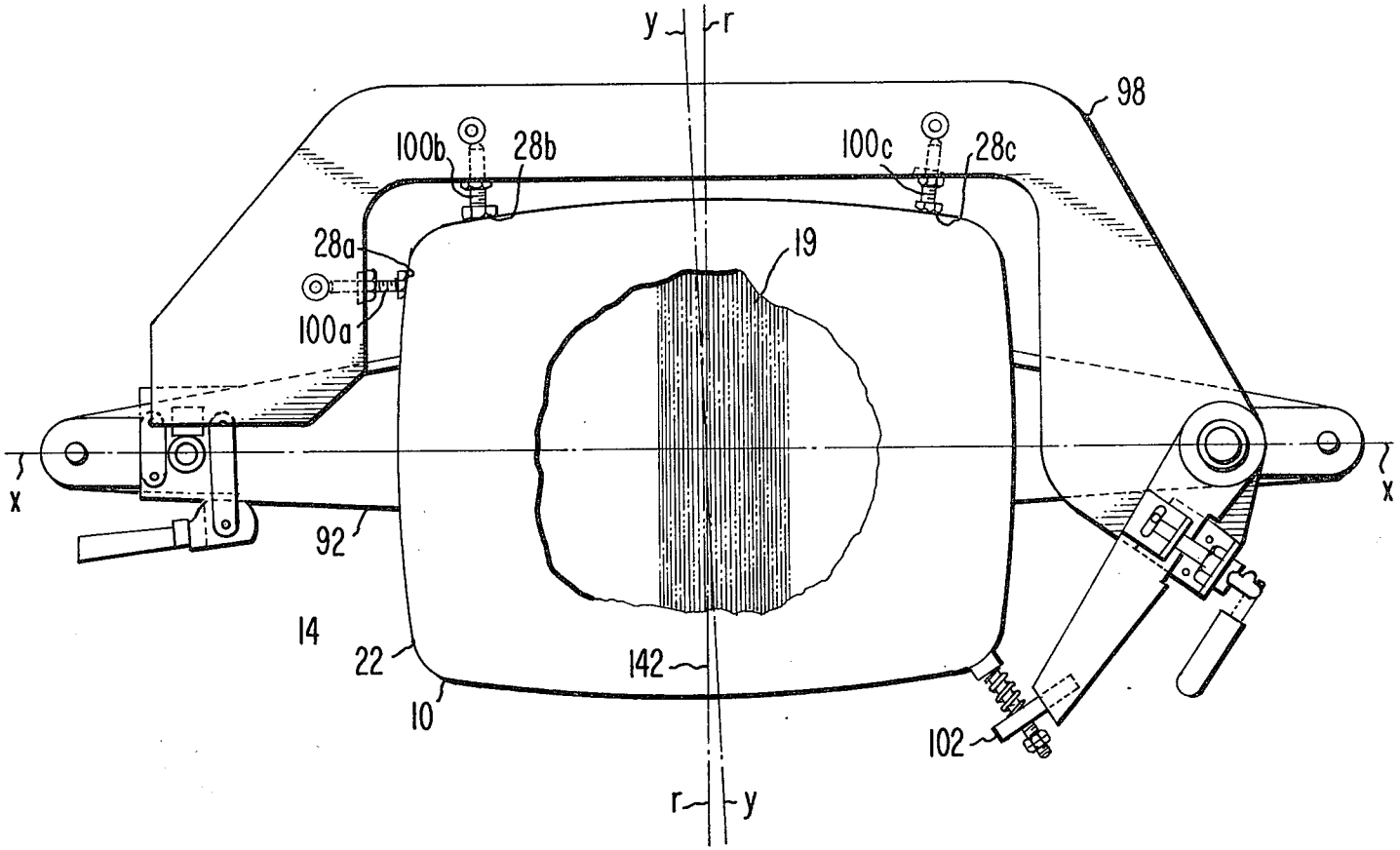
FIG. 2 is a plan view of the head assembly having a bulb assembly installed therein showing a portion of the illuminated phosphor line pattern thereon.

As stated previously, the faceplate panel portion 22 is preferably of a rectangular shape and includes three reference surfaces 28*a*, 28*b* and 28*c* as shown in FIG. 2. The reference surface 28*a* defines one of the smaller sides, and the reference surfaces 28*b* and 28*c* define one of the larger sides of the rectangularly shaped faceplate portion 22. The reference surfaces also define the position of the major axis X—X and the minor axis Y—Y for the faceplate portion 22, the minor axis Y—Y being perpendicular to the major axis X—X. The central longitudinal axis A—A of the bulb assembly 10 passes centrally through the neck portion 26 and the intersection of the major axis X—X and the minor axis Y—Y.

As stated above, the parallel phosphor lines 19 of the viewing screen structure generally extend parallel to the minor Y—Y of the faceplate 22. However, misalignment of the aperture-mask electrode 20 with respect to the major and minor axes of the faceplate 22 can cause the parallel phosphor lines 19 to extend at an angle with respect to the minor axis Y—Y as shown in FIG. 2, where line *r*—*r* is parallel to the parallel phosphor lines 19. However, such misalignment is generally very small; consequently, a rectangular scan pattern, if aligned with the phosphor lines 19, will still fit the rectangular outline of the panel without noticeable rotation.

Figure 3:
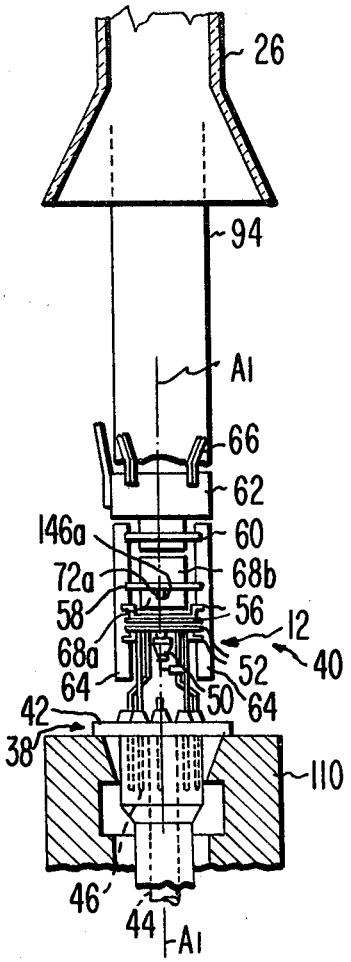
FIG. 3 is an elevational view of a mount assembly positioned on a mount support assembly of the mount sealing machine.

As shown in FIG. 3, the mount assembly 12 comprises a stem assembly 38 and a multi-beam electron gun assembly 40. The stem assembly 38 includes the stem 42, exhaust tubulation 44 and stem leads 46. The stem leads 46 are located on the circumference of the circle which is concentric with the central longitudinal axis $A_1$—$A_1$ of the mount assembly 12. The multi-beam electron gun assembly 40 includes three cathodes 50, a control grid or $G_1$ grid 52, a screen grid or $G_2$ grid 56, a first accelerating and focusing grid or $G_3$ grid 58, a second accelerating and focusing grid or $G_4$ grid 60, and a shield cap 62. The various grids are mounted on glass support rods 64. The shield cap 62 may also include bulb spacers 66 for centering the gun assembly within the neck portion 26.

The multi-beam electron gun assembly 40 is preferably of the type known in the art as "in-line". An in-line electron gun assembly includes three equally spaced coplanar cathodes, one for each electron beam. In one preferred in-line electron gun assembly, such as described in U.S. Pat. No. 3,772,554 issued to R. H. Hughes, the grid electrode for all three cathodes are each formed in one piece. For example, the $G_1$ grid 52, $G_2$ grid 56, $G_3$ grid 58 and $G_4$ grid 60 are each one piece, each having three apertures, one for each electron beam.

In the in-line electron gun assembly 40 shown in FIG. 3, the $G_3$ grid 58 is formed in the shape of a lower cup 68*a* and an upper cup 68*b* attached at their open ends. Each of the cups include three in-line apertures 70 (see FIG. 6), one for each of the three cathodes 50. The lower cup 68*a* is formed with a pair of narrow slits 72*a* and 72*b* on opposite ends thereof (see FIG. 7). The narrow slits 72*a* and 72*b* lie within a plane formed by a center line 74 through the apertures 70 (see FIG. 6) and the central longitudinal axis $A_1$—$A_1$ of the mount assembly. The central longitudinal axis $A_1$—$A_1$ of the mount assembly 12 is also coincident with the axis of the center cathode.

It is preferred that a multi-head rotary sealing machine 14, partially shown in FIG. 1, be used to practice the method disclosed herein. The rotary unit includes separate processing stations for loading, preheating, sealing, annealing and unloading. The sealing machine 14 includes a rotatable head assembly 76, having a central longitudinal axis $A_2$—$A_2$, for each processing station. The head assembly 76 includes a support frame assembly 78, a bulb alignment assembly 80, a neck chuck 82, a mount support assembly 84, a mount rotating fixture 86 and a sealing fire assembly (schematically shown by arrow 88).

The support-frame assembly 78 includes a lower support 90 and an upper support 92. The lower support 90 is rotatably mounted on the mount sealing machine 14 in bearings (not shown). The lower support 90 includes two vertical support rods 94. The upper support 92 is mounted on top of the two support rods 94. The upper support 92 includes a bulb support member 96 formed to hold the bulb assembly at a specified diameter on the funnel portion 24 known as the yoke reference line.

The bulb alignment assembly 80 is also mounted on the upper support 92. The bulb alignment assembly 80 includes a C-shaped support 98 having three reference units 100*a*, 100*b* and 100*c* for orienting the bulb assembly 10 and a bulb clamp assembly 102 for retaining the bulb assembly 10 against the three reference units as shown in FIGS. 1 and 2. The neck chuck 82 is mounted on the two vertical rods 94. The neck chuck 82 comprises two jaws 104 and actuating means 106 for equally moving the jaws.

As shown in FIG. 1, the mount support assembly 84 is mounted on the lower support 90. The mount support assembly 84 includes a mount seal spindle 108 and a mount pin 110. The mount seal spindle 108 is slideably mounted in the lower support 90. The lower end of the mount seal spindle 108 slides on a vertically displaced track (not shown) during indexing of the sealing unit 14.

The mount rotating fixture 86 is mounted on the mount seal spindle 108 of the mount support assembly 84. The mount rotating fixture 86 is constructed to slideably contact the two vertical support rods 94 to prevent undesired rotational movement of the mount support assembly 84 about the central longitudinal axis $A_2$—$A_2$ while permitting longitudinal movement along the $A_2$—$A_2$ axis. The mount rotating fixture 86 also includes means for adjusting the rotational orientation of the mount assembly 12 with respect to the phosphor lines 19 on the viewing screen structure 18 prior to the insertion of the mount assembly 12 in the neck portion 26 of the bulb assembly 10.

Figure 4:
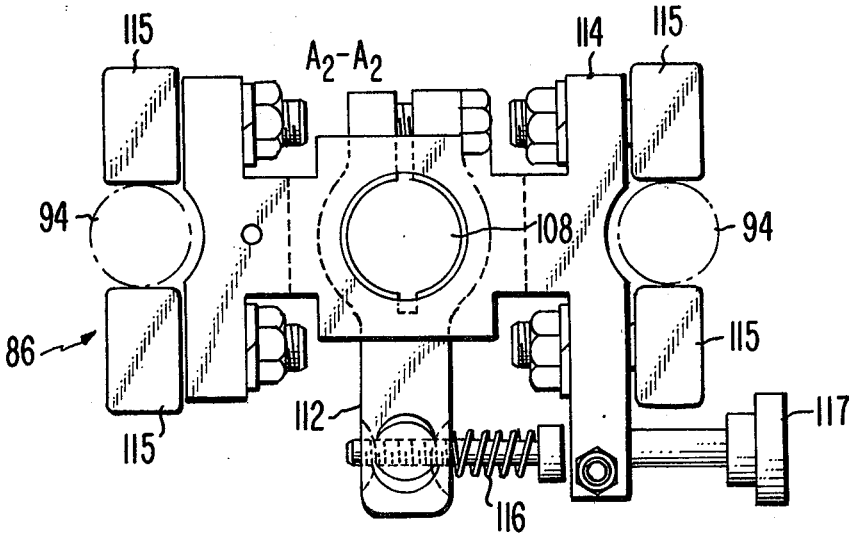
FIG. 4 is a plan view of a mount rotating fixture.

As shown in FIG. 4, the mount rotating fixture 86 comprises a spindle alignment arm 112 which is rigidly fastened to the mount seal spindle 108 and a fixture body 114 having rollers 115 which roll along the two vertical support rods 94. The rotational adjusting means comprises an adjusting knob 117 on an alignment screw 116 which extends through the fixture body 114 and engages a threaded portion on the spindle alignment arm 112. Turning the adjusting knob 117 causes the spindle alignment arm 112 to rotate with respect to the fixture body 114. Since the fixture body 114 is fixed with respect to the central longitudinal axis $A_2$—$A_2$, the rotational adjustment means controls the rotational orientation of the spindle alignment arm 112 about the central longitudinal axis $A_2$—$A_2$.

The mount sealing machine 14 includes means attached thereto for optically sensing the rotational orientation of the phosphor lines 19 on the viewing screen structure 18. As shown in FIG. 1, a phosphor line pattern optical sensing means, generally referred to as 101, comprises a support structure 103 which is rigidly mounted to the main frame (not shown) of the mount sealing machine 14. The support structure 103 supports an ultra-violet light source 105 and an optical viewing means such as a television camera 107. The ultra-violet light source 105 is positioned such that it illuminates a portion of the faceplate panel 22 which encompasses the central longitudinal axis $A_2$—$A_2$, causing the phosphor strips within the illuminated portion to fluoresce. The television camera 107 is positioned on the support structure 103 such that its field of view comprises at least that portion of the faceplate panel 22 which is illuminated by the ultra violet light source 105.

Figure 5:
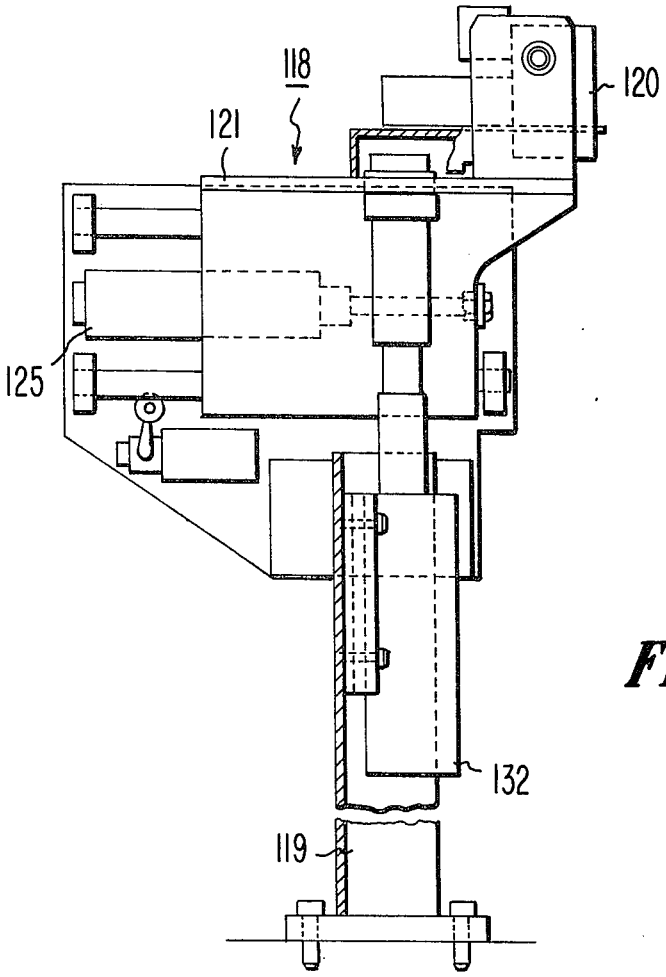
FIG. 5 is an elevational view of a mount assembly rotation sensing apparatus.
Figure 6:
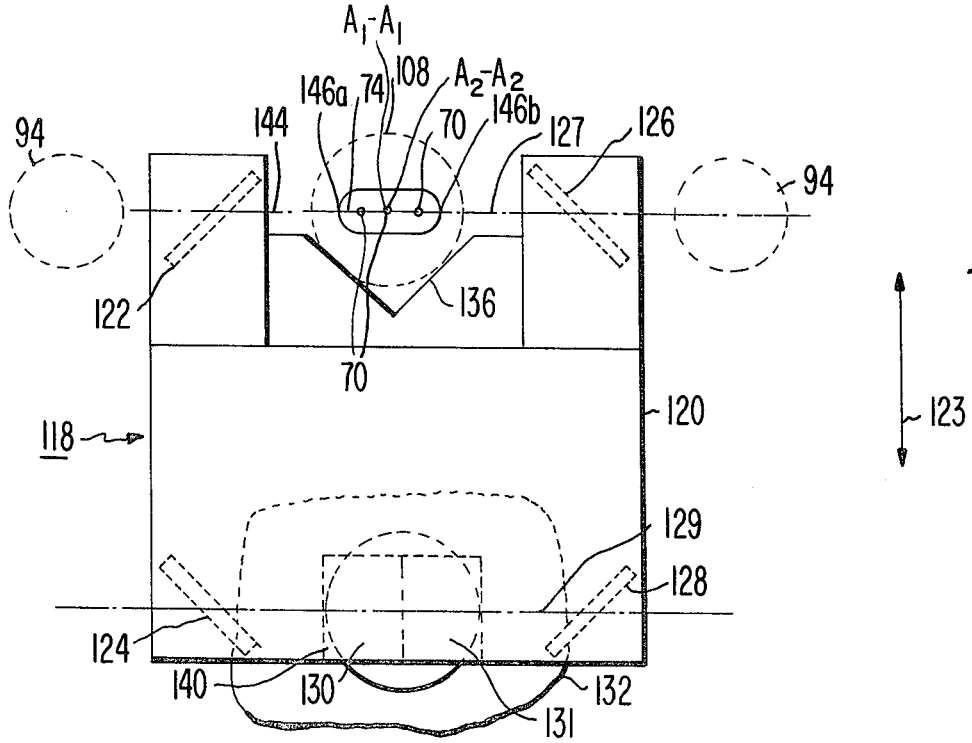
FIG. 6 is a plan view of a portion of the mount assembly rotation sensing apparatus shown in FIG. 5.
Figure 7:
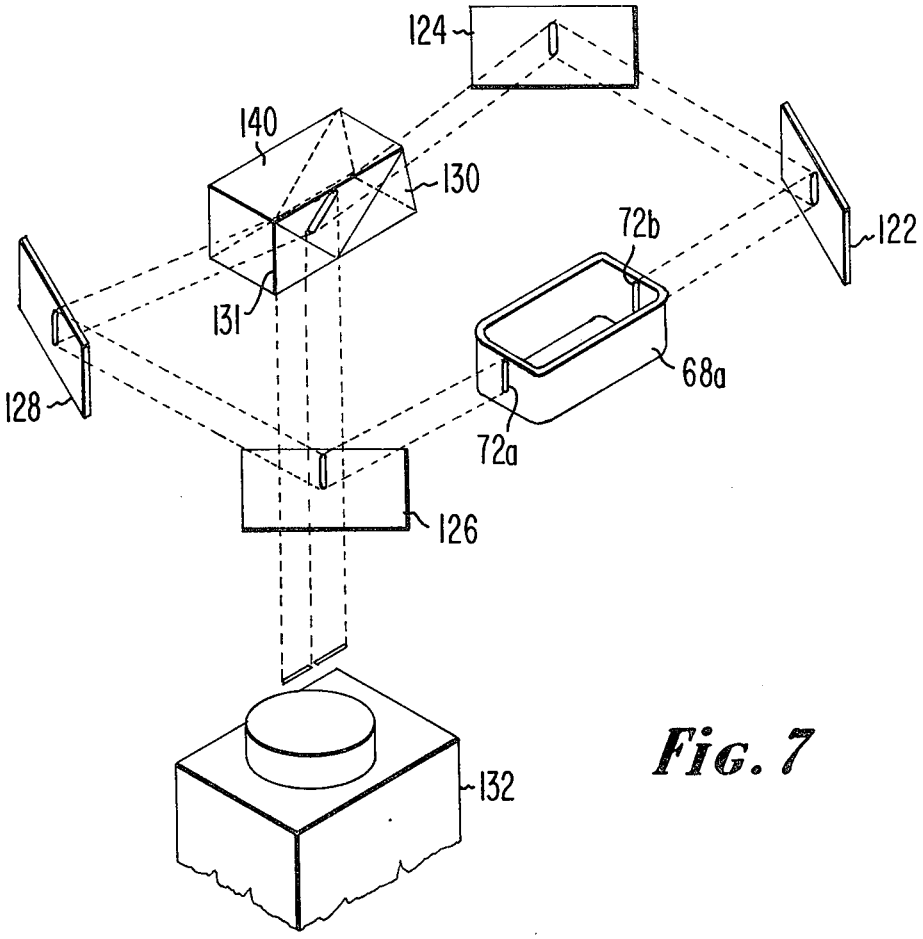
FIG. 7 is a schematic diagram indicating the optical imaging paths of the optical sensing apparatus of FIGS. 5 and 6.

The mount sealing machine 14 also includes means attached thereto for optically sensing the rotational orientation of the mount assembly 12 with respect to the phosphor lines 19 of the viewing screen structure 18. As shown in FIGS. 5 and 6, the mount assembly rotation sensing means, generally referred to as 118, comprises a support 119 which is rigidly connected to the main frame (not shown) of the mount sealing machine 14 through a machine base (not shown). An aligner body 120 is slideably mounted on the support 119 by means of an engaging slide structure 121. The engaging slide structure 121 prevents undesired rotational movement of the aligner body 120 about the central longitudinal axis $A_2$—$A_2$ while permitting movement of the aligner body between a standby position and a sensing position the directions indicated by the double ended arrow 123 in FIG. 6.

The aligner body 120 includes one V shaped surface 136 which is constructed to contact the mount seal spindle 108 when the aligner body is in the sensing position. A first image collecting mirror 122 and a second image collecting mirror 126 are mounted on the aligner body 120. It is to be noted that each of the mirrors used in the mount assembly rotation sensing means 118 is preferably a first surface mirror having a substantially planar reflecting surface. The planar reflecting surfaces of the first and second image collecting mirrors face toward the central longitudinal axis $A_2$—$A_2$ intersecting, at a 45° angle, a first aligner body reference plane 127 which contains the $A_2$—$A_2$ axis. The intersecting loci of the first aligner body reference plane 127 with the planar reflecting surfaces of the first 122 and second 126 image collecting mirrors are parallel to and equidistant from the $A_2$—$A_2$ axis as established by the engagement of the V shaped surface 136 with the mount seal spindle 108.

The first 122 and second 126 image collecting mirrors also face a first and a second image directing mirrors, 124 and 128 respectively, which are mounted on the aligner body 120. The planar reflecting surfaces of the first 124 and second 128 directing mirrors face toward each other and toward the first and second image collecting mirrors and intersect, at a 45° angle, a second aligner body reference plane 129 which is parallel to the first aligner body reference plane 127. The intersecting loci of the second aligner body reference plane 129 with the reflecting surfaces of the first and second image directing mirrors are parallel to and substantially equidistant from the $A_2$—$A_2$ axis as established by the engagement of the V-shaped surface 136 with the mount seal spindle 108.

A first imaging prism 130 is mounted adjacent a second imaging prism 131 on a prism mount 140 which is mounted on the aligner body 120 in the second aligner body reference plane 129, equidistant between the first and second image directing mirrors 124 and 128. The reflecting surfaces of the first and second imaging prisms 130 and 131 intersect the second aligner body reference plane 129 at right angles, the intersecting locus of the second reference plane 129 and the first prism 130 forming a 45° angle with the intersecting locus of the first image directing mirror 124, and the intersecting locus of the second reference plane 129 and the second prism 131 forming a 45° angle with the intersecting locus of the second image directing mirror 128. An optical sensing means comprising a television camera 132, is mounted on the support 119 directly below the first and second imaging prisms 130 and 131.

Figure 9:
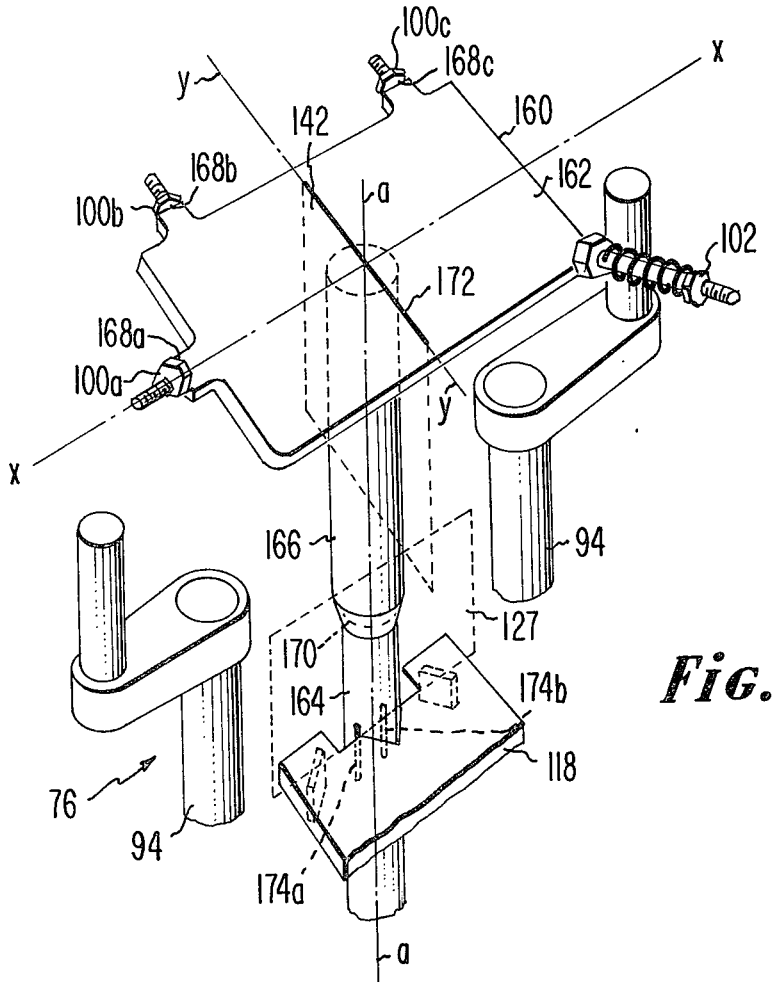
FIG. 9 is a perspective drawing showing an alignment gauge positioned on the head assembly of the mount sealing machine.

The rotatable head assembly 76, the mount assembly rotation sensing means 118 and the phosphor line pattern optical sensing means 101 are initially aligned with an alignment gauge 160, see FIG. 9. The alignment gauge 160 is basically a mechanical dimensional simulator of a television tube bulb assembly and mount assembly. The alignment gauge 160 comprises a rectangular faceplate simulator portion 162 having orthogonal major *x—x* and minor *y—y* axes, a mount assembly simulator portion 164 and a funnel simulator portion 166 disposed between the faceplate simulator 162 and the mount assembly simulator 164. The faceplate simulator portion 162 includes three reference surfaces 168*a*, 168*b* and 168*c* which accurately define the positions of the orthogonal major *x—x* and minor *y—y* axes. A central longitudinal axis *a—a* of the alignment gauge 160 is defined to pass through the intersection of the major and minor axes of the faceplate simulator and the center of a circumference 170 on the funnel simulator portion 166 which defines a simulated yoke reference line. The central longitudinal axis *a—a* and the minor axis *y—y* define a reference plane 142.

The faceplate simulator portion 162 has at least one scribe line 172 thereon which is parallel to the minor axis *y—y* and the reference plane 142. The mount assembly simulator portion has two scribe lines 174*a* and 174*b* on opposite sides of the external surface thereof. The scribe lines 174*a* and *b* are parallel to the central longitudinal axis *a—a* of the alignment gauge 160 and lie within a plane which is perpendicular to the minor axis *y—y* and which contains the central longitudinal axis *a—a.*

The initial alignment is performed by first positioning the alignment gauge 160 on the head assembly 76 of the support frame assembly 78 (see FIG. 1). The surfaces 168*a*, 168*b* and 168*c* on the faceplate simulator portion 162 of the alignment gauge 160 are engaged with the reference units 100*a*, 100*b* and 100*c* to position the scribe lines 174*a* and 174*b* approximately in line with the support rods 94. The bulb clamp assembly 102 and the neck chuck 82 (see FIG. 1) are then clamped. The mount assembly rotation sensing means 118 is moved into position to view the scribe lines 174*a* and 174*b*. The alignment gauge 160 is rotated about the central longitudinal axis *a—a* thereof by means of the rotatable head assembly 76 until the scribe lines 174*a* and 174*b*, as displayed on a television monitor (not shown), appear in end-to-end alignment. The head assembly is then locked to prevent further rotation. The television camera 132 (see FIG. 5) is then rotated as required about its own longitudinal axis to cause the aligned scribed lines to appear in substantially horizontal spaced relation on the TV monitor display. The television camera 107 of the phosphor line pattern optical sensing means 101 (see FIG. 1) is then rotated about its own longitudinal axis until the scribe line 172 on the faceplate simulator portion 162 appears substantially parallel to the scribe lines 174*a* and 174*b* on the television monitor display. At this time, the first aligner body reference plane 127 is perpendicular to the reference plane 142.

After the initial alignment procedure has been completed, a bulb assembly 10 is positioned in the head assembly 76 on the support frame assembly 78 adapted to hold and orient the bulb assembly 10. As shown in FIGS. 1 and 2, the surfaces 28*a*, 28*b* and 28*c* on the faceplate panel 22 of the bulb assembly 10 are engaged with the reference units 100*a*, 100*b* and 100*c* respectively to prevent undesired rotational movement of the bulb assembly 10 with respect to the support frame assembly 78. The bulb clamp assembly 102 and the neck chuck 82 are then clamped. This causes the alignment of the central longitudinal axis A—A of the bulb assembly 10 to be coincident with the central longitudinal axis $A_2$—$A_2$ of the head assembly 76.

A portion of the faceplate panel 22 of the installed bulb assembly 10 is then illuminated by the ultraviolet light source 105 causing the phosphor lines 19 (see FIG. 2) to fluoresce. The television camera 107 displays these fluorescing phosphor lines in a monitor (not shown). If the bulb assembly 10 is not in the correct rotational position about the coincident axes A—A and $A_2$—$A_2$, the phosphor line image will appear as diagonal lines on the display, see FIGS. 8(*a*) and 8(*b*). To obtain the correct rotational position, the rotatable head assembly 76 is rotated about its central longitudinal axis $A_2$—$A_2$ until the fluorescing phosphor lines appear as substantially horizontal lines on the monitor display (see FIG. 8(*c*)) at which time the head assembly is locked to prevent further rotational movement. Since the fluorescing phosphor lines 19 appear as substantially horizontal lines on the monitor display, they are substantially parallel to the reference plane 142 as established in the initial alignment procedure.

A mount assembly 12 is then positioned on a mount support assembly 84 adapted to hold and orient the mount assembly 12 with the central longitudinal axis $A_1$—$A_1$ thereof coincident with the central longitudinal axis A—A of the bulb assembly 10 and the central longitudinal axis $A_2$—$A_2$ of the head assembly 76. The mount assembly 12 is positioned on the mount pin 110 with the bottom of the stem 42 substantially in full surface contact (not tilted) with the top surface of the mount pin 110 as shown in FIG. 3. The stem leads 46 are engaged within the mount pin 110 to substantially center the central longitudinal axis $A_1$—$A_1$ of the mount assembly 12 coincident with the central longitudinal axis $A_2$—$A_2$ of the head assembly 76, and consequently coincident with the central longitudinal axis A—A of the bulb assembly 10.

An orientation plane 144 is defined with respect to the structure of the electron gun assembly 40 by selecting a first reference point 146*a* and a second reference point 146*b* (see FIGS. 3 and 6) on the electron gun structure. The two points are spaced from each other and radially spaced around the central longitudinal axis $A_1$—$A_1$ of the mount assembly 12. The orientation plane 144 is then defined as that plane which contains two points 146*a* and 146*b* and a line parallel to the central longitudinal axis $A_1$—$A_1$ of the mount assembly 12.

For an in-line multi-beam electron gun assembly as shown in FIGS. 3 and 6, it is preferred that the orientation plane 144 pass through the apertures 70 in the $G_3$ grid 58. Since, as previously stated, the slits 72*a* and 72*b* in the lower cup 68*a* of the $G_3$ grid 58 lie within the plane formed by the center line 74 through the aperture 70 in the $G_3$ grid 58 and the central longitudinal axis $A_1$—$A_1$ of the mount assembly, the orientation plane 144 for the in-line multi-beam electron gun assembly is defined by the slits 72*a* and 72*b* and the central longitudinal axis $A_1$—$A_1$.

To obtain the desired rotational alignment of the in-line multi-beam electron gun assembly 40 with respect to the phosphor lines 19 of the viewing screen structure 18, the mount assembly 12 is rotated with respect to the bulb assembly 10 about the coincident central longitudinal axes $A_1$—$A_1$ and A—A until the orientation plane 144 is perpendicular to the reference plane 142. At this point, the orientation plane 144 is also perpendicular to the phosphor lines 19 and the mount assembly 12 is in proper rotational alignment with respect to the bulb assembly 10.

In order to determine the orthogonality of the orientation plane 144 with the reference plane 142, the mount assembly rotation sensing means 118 is operated to move the aligner body 120 on the engaging slide structure 121 from the standby position to the sensing position. In the sensing position, the V-shaped surface 136 of the aligner body 120 engages the mount seal spindle 108 at which point the slits 72*a* and 72*b* in the lower cup 68*a* of the $G_3$ grid are in the field of view of the sensing means 118. An air cylinder 125 is used to exert a force to move the aligner body 120 into the sensing position and to maintain the V-shaped surface 136 in contact with the mount seal spindle 108. (See FIGS. 5 and 6.)

At this time, the mount assembly 12 may not be precisely at the desired rotational alignment. A display of the two slits 72*a* and 72*b* on the television monitor (not shown) will disclose any rotational misalignment. As shown schematically in FIG. 7, the images of the two slits 72*a* and 72*b* in the lower cup 68*a* of the $G_3$ grid are reflected to the television camera 132 by the first and second image collecting mirrors 122 and 126; the first and second image directing mirrors 124 and 128; and the first and second imaging prisms 130 and 131. To facilitate viewing, the slits 72*a* and 72*b* may be illuminated by a separate light source (not shown).

Figure 8:
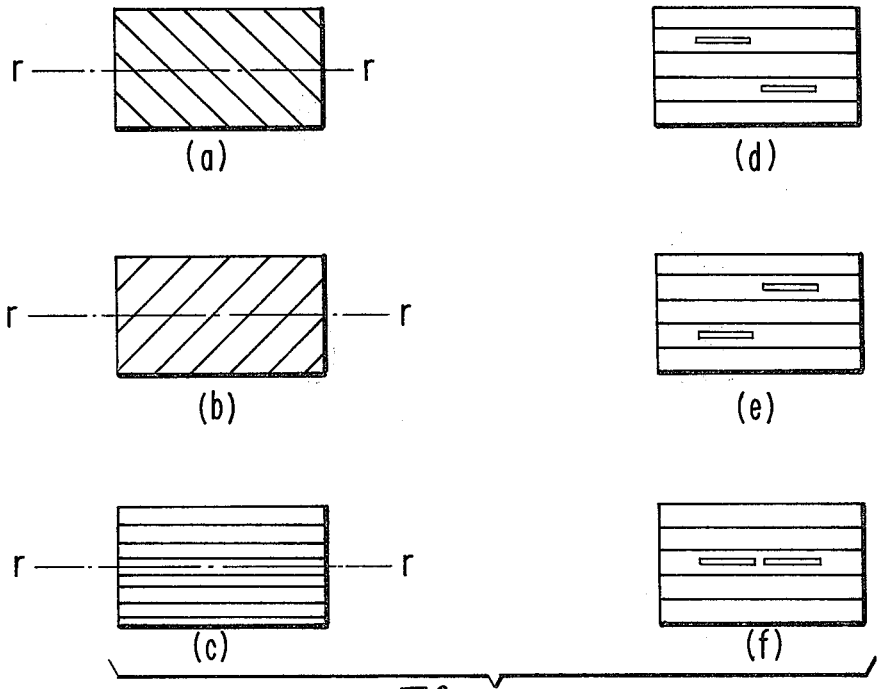
FIG. 8 is a representation of six examples of images displayed on a viewing monitor.

Rotational misalignment is indicated when the images of the two slits 72*a* and 72*b* displayed on the television monitor are not aligned as shown, for example, in FIGS. 8(*d*) and 8(*e*). Rotational misalignment is corrected by turning the knob 117 on the alignment screw 116 of the adjusting means until the images of the two slits are aligned as shown in FIG. 8(*f*). When the images of the two slits are in alignment on the television monitor display and the aligned images are in substantially parallel spaced relation with the images of the phosphor lines, as shown in FIG. 8(*f*), the orientation plane 144 is perpendicular to the reference plane 142 and consequently perpendicular to the phosphor lines 19 of the viewing screen structure 18. After alignment has been achieved, the mount assembly rotation sensing means 118 is withdrawn to the stand-by position by means of the air cylinder 125.

The mount assembly 12 is then moved along the central longitudinal axis $A_2$—$A_2$ of the head assembly 76 to a desired longitudinal location with respect to the face-plate portion 22 of the bulb assembly 10. The mount assembly 12 is guided within the neck portion 26 by bulb spacers 66 which substantially maintain the center of the in-line electron gun assembly on the central longitudinal axis A—A of the bulb assembly 10. At the desired longitudinal location, the stem 42 is sealed within the neck portion 26. The mount assembly 12 is moved into the neck portion 26 during the cycle of the sealing machine 14 by the vertically displaced track previously described. Finally, the bulb assembly 10 and the mount assembly 12 are permanently fixed together. It is preferred that they are fixed by a seal between the stem 42 and the neck portion 26. During the sealing, the lower part of the neck portion 26, known as the cullet, is removed. The sealing of the bulb assembly 10 and the mount assembly 12 also includes preheating and sealing of the glass, as is well known.

Note that although the reference points 146*a* and 146*b* are defined by the slits 72*a* and 72*b* in the embodiment described herein, any type of visible mark or even convenient surfaces of the electron gun assembly itself may be used and should be considered within the scope and intendment of the method disclosed herein.

Although the method describes positioning an in-line electron gun assembly having common electrodes, the method may also be used for other multiple electron gun assemblies having separate individual electrodes for each gun. For example, the method may be used on an in-line or delta electron gun having individual cylindrical electrodes. Where a mount assembly having three individual cylindrical in-line electron guns is used, the two points which define the orientation plane for the electron gun structure are chosen to be at the point where the reference plane intersects the end surfaces on each of the two end in-line electron guns. Other points may also be selected or formed on the electron gun structure with the points being precisely positioned a known dimension from the reference plane and the central longitudinal axis $A_1$—$A_1$ of the mount assembly 12 to establish an orientation plane perpendicular to a reference plane.

Figure 10:
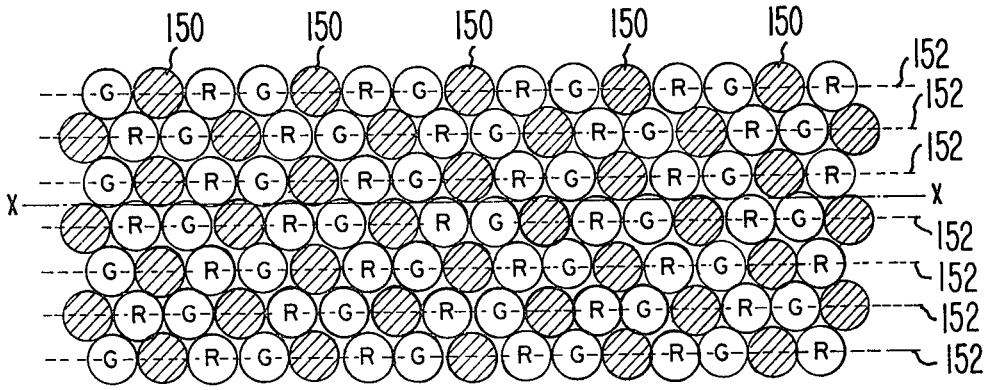
FIG. 10 is a representation of a selectively fluorescing phosphor dot pattern.

In a tube having a delta electron gun assembly, the phosphor pattern comprises recurring groups of three different color emitting phosphor dots in a delta arrangement. In this type of television tube, selective color illumination of the phosphor pattern will cause a specific phosphor color to fluoresce with greater intensity than the other two phosphor colors causing the formation of optically discernible patterns of parallel lines. For example, if long wavelength (on the order of 3800 A) ultra violet light is used to illuminate the phosphor pattern, the blue phosphor dots will fluoresce more brightly than the surrounding green and red phosphor dots. This situation is illustrated in FIG. 10 where the shaded circles 150 represent the more brightly fluorescing blue dots. As shown in FIG. 10, the mosaic of phosphor dots is arranged such that the more brightly fluorescing blue dots 150 will appear to form optically discernible sets of parallel lines, at least one set of which is parallel to the major axis *x*—*x* of the rectangular faceplate. This one set is represented by the parallel dotted lines 152 in FIG. 10. If so desired, the green dots can be selectively illuminated using ultra violet light having a wavelength on the order of 2500 to 2600 A. In this type of tube the reference plane would be rotated 90° from that established for a phosphor line type and the rotatable head assembly 76 would be rotationally adjusted until the discernible line patterns of phosphor dots appeared in substantially horizontal spaced relation on the television monitor. The delta electron gun assembly would then be rotationally aligned such that the orientation plane established thereon is parallel with the reference plane, as indicated by the alignment of the electron gun reference marks on the television monitor.

Although the method disclosed herein describes the use of optical sensing means which include a combination of mirrors and prisms and television cameras, it should be noted that the optical sensing means can include either all mirrors or all prisms or any combination of mirrors and prisms required to form the functions of image collecting, directing and displaying and all such variations are to be considered within the scope and intendment of this disclosure. Also, the television cameras have been included in the description of the method only as one embodiment of a means for displaying an image. This means can also be embodied in, for example, fiber optics or an additional combination of mirrors and prisms required to display the two superimposed images in a single convenient display. Furthermore, the ultra violet light source which is used to cause the phosphor lines or phosphor dots to fluoresce can be replaced by any device which causes fluorescence of these materials. In addition, the multiple head main sealing machine is described only as the preferred apparatus for practicing the method disclosed herein. This method may also be practiced on a single head sealing machine. Also in either apparatus, the head may be held stationary and the fires rotated to make the mount-bulb seal.

As stated previously, the method disclosed herein has the important advantage of permitting the electron beam apertures to be aligned directly to the phosphor strips on the viewing screen. This method of alignment eliminates intermediate sources of error such as reference pad alignment error, stem lead to electron gun assembly alignment error, etc. The method disclosed herein is suitable, not only for orienting the mount assembly prior to its insertion to the bulb assembly as described above, but is also suitable for conducting quality control type checks of the rotational position of the mount assembly with respect to the bulb assembly after mount sealing has taken place.

I claim:

1. A method of assembling a cathode ray tube, said tube including a bulb assembly and a mount assembly, said bulb assembly having a central longitudinal axis and including a faceplate panel having a plurality of phosphor deposits disposed thereon in a predetermined pattern, said mount assembly having a central longitudinal axis and including a multi-beam electron gun assembly, said method comprising the steps of:

a. positioning the central longitudinal axis of said bulb assembly in a predetermined orientation;
b. optically sensing the rotational position of said phosphor pattern about the central longitudinal axis of said bulb assembly;
c. positioning said bulb assembly about the central longitudinal axis thereof so that said phosphor pattern is at a predetermined rotational position;
d. positioning said mount assembly in a location spaced from said bulb assembly with the central longitudinal axis thereof coincident with the central longitudinal axis of said bulb assembly;
e. optically sensing the rotational position of said electron gun assembly about said coincident longitudinal axes;
f. rotating said mount assembly about said coincident longitudinal axes until said electron gun assembly is at a prescribed rotational orientation with respect to said phosphor pattern;
g. then, while maintaining said rotation orientation, moving said mount assembly along said longitudinal axis to a desired longitudinal location with respect to the faceplate panel of said bulb; and
h. permanently fixing said mount assembly to said bulb assembly.

2. The method in accordance with claim 1 in which step *a.* comprises the steps of establishing a field of view which encompasses at least a portion of said faceplate panel containing the central longitudinal axis of said bulb assembly; establishing a reference plane which contains the central longitudinal axis of said bulb assembly and which intersects said faceplate panel, the locus of intersection forming a substantially horizontal line in said field of view; and displaying said field of view on an optical display.

3. The method in accordance with claim 2 in which step *b.* includes causing at least a portion of said phosphor pattern contained within said field of view to fluoresce in order to create optically discernible line patterns within said phosphor pattern and displaying the fluorescing line patterns on said optical display.

4. The method in accordance with claim 3 in which said fluorescence is caused by illuminating said phosphor pattern with ultra violet light.

5. The method in accordance with claim 4 in which step *c.* includes rotating said bulb assembly about the central longitudinal axis thereof until at least one of said fluorescing line patterns appear in substantially horizontal spaced relation on said optical display.

6. The method in accordance with claim 5 in which step *e.* comprises the steps of defining an orientation plane parallel to the coincident longitudinal axes, said orientation plane including at least two reference points on the structure of said electron gun assembly, said reference points being spaced from each other and radially spaced around the central longitudinal axis of said mount assembly; and sensing the rotational position of said orientation plane with respect to said reference plane by optically sensing the position of said reference points with respect to each other.

7. The method in accordance with claim 6 wherein said faceplate panel is substantially rectangular, having a major axis and a minor axis, and said predetermined pattern of phosphor deposits disposed thereon comprises a mosaic of recurring groups of different color emitting, parallel phosphor lines, said phosphor lines being generally parallel to said minor axis, and step *c.* includes rotating said bulb assembly about the central longitudinal axis thereof until said phosphor lines are substantially parallel to the locus of intersection of said reference plane with said faceplate panel as indicated by the appearance of said fluorescing phosphor lines in substantially horizontal spaced relation on said optical display.

8. The method in accordance with claim 7 wherein said electron gun assembly comprises an in-line electron gun having at least one common grid, said common grid having three in-line electron beam apertures therein, the center aperture being coincident with the central longitudinal axis of the mount assembly, and step *e.* includes the step of defining said orientation plane through said in-line electron beam apertures, said orientation plane including the central longitudinal axis of the mount assembly and two reference points located on opposite sides of said common grid.

9. The method in accordance with claim 8 in which step *e.* includes the step of defining said orientation plane to be in orthogonal spaced relation to said reference plane when said electron gun assembly is in proper alignment with respect to said phosphor lines.

10. The method in accordance with claim 9 in which step *f.* comprises rotating said mount assembly about said coincident longitudinal axes until said orientation plane is in orthogonal spaced relation to said reference plane as indicated by the alignment of said two reference points on a split-image optical display.

11. The method in accordance with claim 10 comprising the additional step of superimposing said split-image optical display on the optical display of the phosphor lines such that said aligned reference points and said phosphor lines appear in parallel spaced relation when the electron gun assembly is in proper alignment with respect to said phosphor lines.

12. The method in accordance with claim 6 wherein said faceplate panel is substantially rectangular, having a major axis and a minor axis, and said predetermined pattern of phosphor deposits disposed thereon comprises a mosaic of recurring groups of phosphor dots, each group comprising three different color emitting phosphor dots in a delta array, said optically discernible line patterns comprising a plurality of dots of one color which fluoresce with greater intensity than the other two colors, at least one line pattern being generally parallel to said major axis and step *c.* includes rotating said bulb assembly about the central longitudinal axis thereof until said one line pattern is substantially parallel to the locus of intersection of said reference plane with said faceplate panel as indicated by the appearance of said one fluorescing line pattern in substantially horizontal spaced relation on said optical display.

13. The method in accordance with claim 12 wherein said electron gun assembly comprises three electron guns disposed in a delta array symmetrically about the central longitudinal axis of the mount assembly, and step *e.* includes the step of defining the orientation plane through the apertures of two electron guns, parallel to said coincident longitudinal axes.

14. The method in accordance with claim 13 in which step *e.* includes the step of defining said orientation plane to be in parallel spaced relation to said reference plane when said electron gun assembly is in proper alignment with respect to said mosaic of phosphor dots.

15. The method in accordance with claim 14 in which step *f.* comprises rotating said mount assembly about said coincident longitudinal axes until said orientation plane is in parallel spaced relation to said reference plane as indicated by the alignment of said two reference points in a split-image optical display.

16. The method in accordance with claim 15 comprising the additional step of superimposing said split-image optical display on the optical display of said fluorescing line pattern such that said aligned reference points and said one fluorescing line pattern appear in parallel spaced relation when the electron gun assembly is in proper alignment with respect to said mosaic of phosphor dots.

17. A method of assembling a color television picture tube, said tube including a bulb assembly having a central longitudinal axis, a rectangular faceplate panel having a major axis, a minor axis and a plurality of phosphor deposits disposed on one surface thereof in a predetermined pattern, and a neck portion; and a mount assembly having a central longitudinal axis and including a multi-beam electron gun assembly and a stem assembly, said method comprising the steps of:

a. positioning a phosphor line pattern optical alignment means with respect to a bulb support, adapted to hold the bulb assembly in a predetermined orientation with respect to the central longitudinal axis thereof, such that the locus of intersection of a reference plane, containing said central longitudinal axis, with the faceplate panel is in horizontal spaced relation with respect to an optical display;

b. positioning the bulb assembly on the bulb support;

c. illuminating a portion of the faceplate panel which encompasses the central longitudinal axis of the bulb assembly with an ultra violet light source to effect fluorescence of a pluraltiy of sets of parallel line patterns disposed within said portion, at least one set of said parallel line patterns being substantially parallel to said major axis of said faceplate panel;

d. displaying said fluorescing phosphor line patterns on said optical display;

e. rotating said bulb assembly about the central longitudinal axis thereof until said one set of parallel phosphor line patterns appears in substantially horizontal spaced relation on said optical display;

f. positioning a mount assembly on a rotatable mount support adapted to hold said mount assembly with the central longitudinal axis thereof coincident with the central longitudinal axis of said bulb assembly;

g. moving an electron gun assembly optical alignment means into contact with said mount support to orient said electron gun assembly optical alignment means with respect to said reference plane;

h. optically sensing two preselected spaced reference points on the structure of said electron gun assembly, said points defining an orientation plane that passes through the apertures of at least two electron guns and is parallel to the central longitudinal axis of said mount assembly;

i. optically comparing the relative position of said two reference points on a split-image display which is superimposed on the optical display of said one set of parallel phosphor line patterns;

j. rotating said mount assembly in said mount support until the two reference points are aligned on said split-image display in substantially parallel spaced relation with the display of said one set of parallel phosphor line patterns, whereby said orientation plane is substantially parallel to said reference plane;

k. then, while maintaining said rotational orientation and coincident longitudinal axes, axially moving said mount assembly into said bulb assembly until the stem assembly is in the desired longitudinal position with respect to said faceplate panel; and l. sealing said stem assembly and said neck assembly to form a color television picture tube assembly.

18. A method of assembling a color television picture tube, said tube including a bulb assembly having a central longitudinal axis, a rectangular faceplate panel having a major axis, a minor axis and a plurality of phosphor deposits disposed on one surface thereof in a mosaic of recurring groups of three different color emitting, parallel phosphor lines, said phosphor lines being generally parallel to said minor axis, and a neck portion; and a mount assembly having a central longitudinal axis and including a multi-beam electron gun assembly having three in-line electron beam apertures and a stem assembly, said method comprising the steps of:

a. positioning a phosphor line pattern optical alignment means with respect to a bulb support, adapted to hold the bulb assembly in a predetermined orientation with respect to the central longitudinal axis thereof, such that the locus of intersection of reference plane, containing said central longitudinal axis, with the faceplate panel is in horizontal spaced relation with respect to an optical display;

b. positioning the bulb assembly on the bulb support;

c. illuminating a portion of the faceplate panel which encompasses the central longitudinal axis of the bulb assembly with an ultra violet light source to effect fluorescence of the phosphor lines disposed within said portion;

d. displaying said fluorescing phosphor lines on said optical delay;

e. rotating said bulb assembly about the central longitudinal axis thereof until said fluorescing phosphor lines appear as horizontal lines on said optical display;

f. positioning said mount assembly on a rotatable mount support adapted to hold said mount assembly with the central longitudinal axis thereof coincident with the central longitudinal axis of said bulb assembly;

g. moving an electron gun assembly optical alignment means into contact with said mount support to orient said electron gun assembly optical alignment means with respect to said reference plane;

h. optically sensing two preselected, spaced reference points on the structure of said electron gun assembly, said points defining an orientation plane that passes through said in-line electron beam apertures and contains the central longitudinal axis of said mount assembly;

i. optically comparing the relative positions of said two reference points on a split-image display which is superimposed on the optical display of said phosphor lines;

j. rotating said mount assembly in said mount support until said two reference points are aligned on said split-image display in substantially parallel spaced relation with the display of said phosphor lines, whereby said orientation plane is substantially perpendicular to said reference plane;

k. then, while maintaining said rotational orientation and coincident longitudinal axes, axially moving said mount assembly into said bulb assembly until the stem assembly is in the desired longitudinal position with respect to said faceplate panel; and l. sealing said stem assembly and said neck assembly to form a color television picture tube assembly.

* * * * *